US005240650A

United States Patent [19]

Wiederhold et al.

[11] Patent Number: 5,240,650

[45] Date of Patent: Aug. 31, 1993

[54] VENTILATION NOZZLE FOR FLUIDS

[75] Inventors: Johannes Wiederhold, Böbrach; Simon Redl, Reichertshausen, both of Fed. Rep. of Germany

[73] Assignee: Anton Steinecker Entwicklungs GmbH & Co., Fed. Rep. of Germany

[21] Appl. No.: 948,090

[22] Filed: Sep. 18, 1992

[30] Foreign Application Priority Data

Sep. 18, 1991 [DE] Fed. Rep. of Germany ... 9111657[U]

[51] Int. Cl.[5] ..... B01F 3/04

[52] U.S. Cl. ..... 261/76; 261/DIG. 75

[58] Field of Search ..... 261/76, DIG. 75

[56] References Cited

U.S. PATENT DOCUMENTS

| | | | |
|---|---|---|---|
| 1,677,265 | 7/1928 | Boving | 261/DIG. 75 |
| 4,098,851 | 7/1978 | Schulte et al. | 261/DIG. 75 |
| 4,562,014 | 12/1985 | Johnson | 261/76 |
| 4,743,405 | 5/1988 | Durao et al. | 261/76 |
| 4,842,777 | 6/1989 | Lamort | 261/DIG. 75 |
| 4,936,552 | 6/1990 | Rothrock | 261/DIG. 75 |
| 5,004,484 | 4/1991 | Stirling | 261/76 |

FOREIGN PATENT DOCUMENTS

| | | | |
|---|---|---|---|
| 694918 | 7/1953 | United Kingdom | 261/DIG. 75 |

*Primary Examiner*—Tim Miles

*Attorney, Agent, or Firm*—Seed and Berry

[57] ABSTRACT

The invention relates to a ventilation nozzle for fluids. In order to enable a simple cleaning and an inexpensive manufacture, the fluid channel in the ventilation nozzle is formed of two telescopically assembled tube sections. The two tube sections are connected to each other by radially outwardly protruding flanges and by fixing screws which are distributed along their circumference, with the flange of the tube section sealing the annular channel to the environment being mounted to its frontal end.

19 Claims, 1 Drawing Sheet

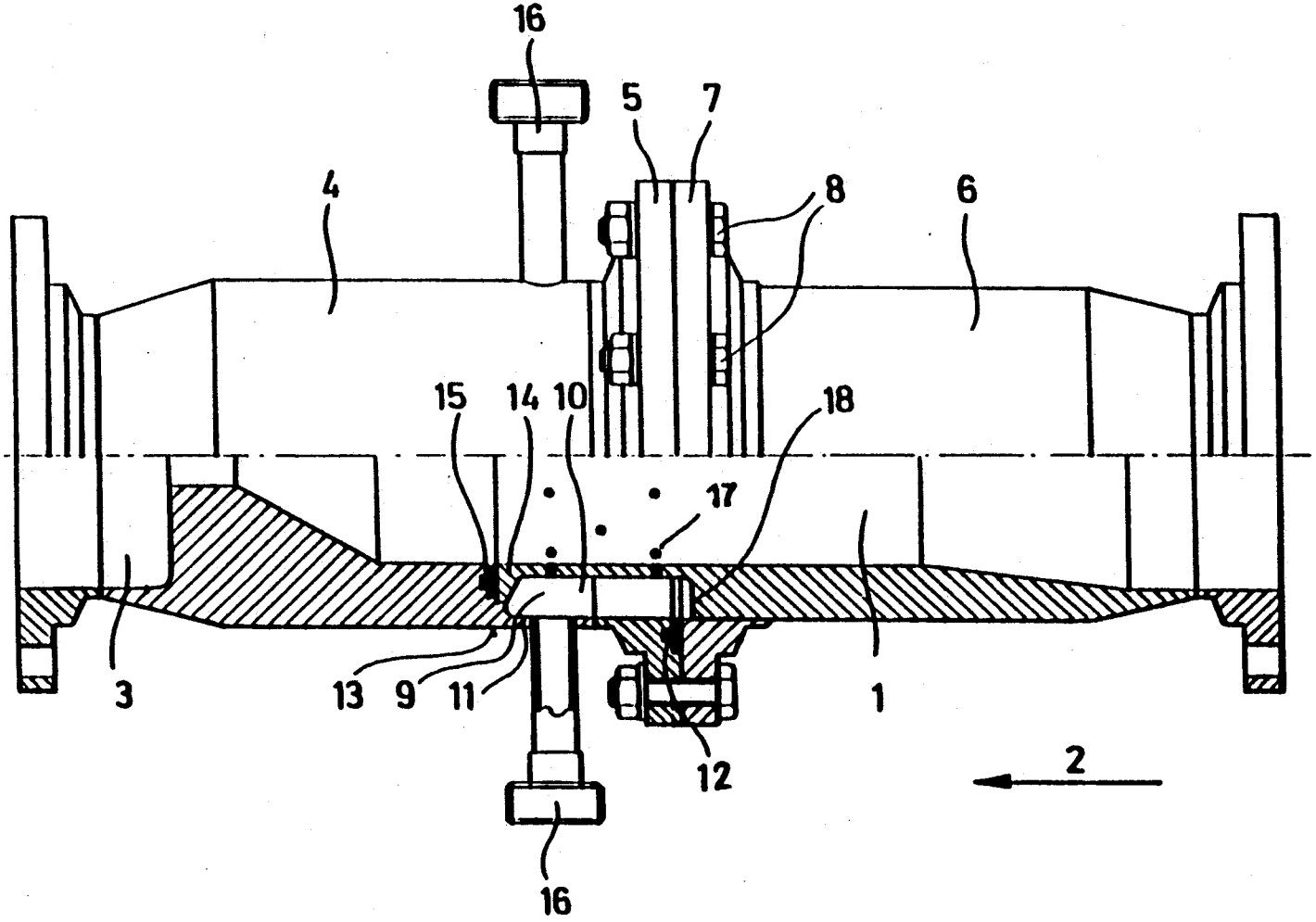
2
6
1
8
18
7
17
12
5
10
16
14
16
15
11
9
13
4
3

VENTILATION NOZZLE FOR FLUIDS

The invention relates to a ventialtion nozzle for fluids especially for ventilating and atomizing wort and yeast, having of a fluid channel which tapers in flow direction, a gas supply line for adding a gas to the fluid channel and an expansion chamber connected to the taper in flow direction.

Such a ventilation nozzle is already known from modern practice. E.g. So-called Venturi nozzles are used. A gas stream is added to the fluid flowing through the Venturi nozzle, so that the gas mixes with the fluid and the fluid is atomized in an expansion chamber which is connected to the Venturi-nozzle.

Such a ventilation nozzle is used in e.g. in brewing technology for ventilation of the wort and for ventilation of the yeast. If the wort flowing into the nozzle is mixed with air, a fine distribution of the air in the wort is obtained, with the flotation effect being influenced in a favourable manner. In case of a very fine distribution of the air bubbles in the wort, a very regular formation of foam cover is obtained in the floatation. The utilized nozzles are usually formed of one piece. Thus, its interior is difficult to clean.

In view to this prior art, it is the object of the invention to provide a ventilation nozzle for fluids, the interior of which is easy to clean, and which is simple and cheap in manufacture.

According to the invention, this object is solved in that the fluid channel consists of two tube sections which are connected to one another in telescope fashion, so that the extremely overlapping sections of the tube sections limit an annular channel, which is defined by circumferential recesses provided on the outer surface of one of the tube sections and on the inner surface of the other tube section, and which is sealed by seals provided at the opposite front end of the tube sections with respect to the fluid channel on one hand and with respect to the environment on the other hand, that the portion separating the annular channel from the fluid channel of the one tube section is provided with gas passage apertures, with the gas supply line opening into the rannular channel, and that the two tube sections are connected to each other by means of radially outwardly protruding flanges and fixing screws distributedly arranged at their circumference, with the flange of the tube section sealing the annular channel to the outside being attached at its front end.

By fact, that the fluid channel consists of two tube sections, the fluid channel can be divided in two parts, with is inner surface becoming easily accessible and thus becoming easily to clean. Since the overlapping portions limit an annlar channel, the innner side of this annular channel is also easily accessible when the two tube sections are diassembled. In disassembling the tube sections, the region of the gas passage apertures is accessible from both sides, so that the gas passage apertures are also easy to clean.

Furthermore, the manufacture of the ventilation nozzle is especially simple based on the two-piece structure of the fluid channel and thus very inexpensive. The annular channel can be easily manufactured in that the one portion of the tube section, comprising the frontal flange is turned out, whereby the recess surrounding the inner surface results. The other portion of the tube section is turned at its outer circumference, whereby the circumferential recess on the outer surface of this tube section is formed. In the latter, the gas passage apertures can be easily formed by bores.

Since the tube sections are connected to each other by means of radially outwardly protruding flanges and fixing screws distributedly around their circumference, the assembly and disassembly of the two portions is especially simple and reliable. In the assembled condition, a reliable and regular sealing of the annular channel is attained by the circumference of the ends of the tube sections facing each other.

According to an advantageous embodiment of the invention, the flange which is arranged on the end face has a circumferential groove at its surface facing the other flange, into which one of the seals of the annular channel is inserted. Such a seal reliably seals the annular channel against the environment. A conventional O-ring can be used for example which, after its sealing effect decreases after some time, can be easily replaced by a new sealing ring. It is furthermore of advantage if the tube section comprising the end flange also comprises the other seal sealing the annular channel, which is inserted into a circumferential groove, provided in a shoulder axially spaced from the end of the tube section and extending radially inwardly and axially limiting the annular channel. A conventional, replaceable O-ring can also used as sealing ring, by means of which the annular channel is reliably sealed against the fluid channel. In screwing together the two flanges, a regular and reliable sealing is obtained at the two ends of the tube sections facing each other.

It is of advantage if the frontal end of the other tube section comprises a radially outwardly extending sealing flange extending in the shoulder and correlating with the seal, with the inner diameter of the two tube sections having an equal size at this location. Thus, the two assembled tube sections form the fluid channel at this location having a regularly circumferential constant inner diameter.

It is also of advantage if the circumferential groove has a T-like cross-section, since in this case a seal inserted therein and having the same diameter results in an especially reliable sealing effect.

According to an advantageous embodiment of the invention, the gas supply line is connected to the tube section comprising the frontal flange and opens into the annular channel. The gas can then be directly supplied via the tube section comprising the frontal flange into the annular channel, in which the gas is regularly distributed and is supplied via the gas passage apertures disposed in the other tube section to the fluid channel. In the disassembly of the ventilation nozzle the portion comprisising the gas supply lines as well as the portion comprising the gas passage apertures are separated and easily accessible.

Preferably, the frontal flange is manufactured as a separate component and is mounted to the tube section preferably by welding. It forms a portion of the radial outer limitation of the annular channel. Thus, inexpensive standard components can be used for the flange. Furthermore, the manufacture of the tube section comprising the frontal flange is facilitated, since only one portion of the recess extending on the inner surface, i.e. a portion of the outer limitation of the annular channel, has to be turned out. In case the inner diameter of the frontal flange corresponds to the inner diameter of the recess extending on the inner suface of the tube section, the outer limit of the annular channel has a constant diamter over the entire length.

It is also of advantage if the flange of the other tube section is radially put onto the tube section as a separate component, and affixed there preferably by welding. This facilitates the manufacture of the tube section comprising the flange not arranged at the frontal surface, since besides comprising the recess limiting the annular channel inwardly, it comprises a smooth surface. Furthermore, the separate components are commercially available and are inexpensive. It is also possible, that the flange of the other tube section axially protrudes over a wall axially limiting the annular channel and also forms a portion of the radial outer limitation of the annular channel. Thereby the circumferential recess, which has to be formed on the inner surface of the tube section comprising the frontal flange, is further shortened.

The two flanges can also be identical. This has the advantage, that in production of the ventilation nozzle only one type of flange has to be available. These flanges can then be easily mounted to the two tube sections by welding.

Furthermore, the flanges can be arranged approximately in the center of the ventilation nozzle. This facilitates the storing of the individual tube sections, since they are all of approximately the same length. Furthermore, an advantageous arrangement of the fluid channel in disassembled condition is obtained, since none of the tube sections is too long. Thus, both fluid channels are easiliy accessible for cleaning. The overlapping section of the two tube sections is small in this arrangement, so that the assembly and disassenmbly of the ventilation nozzles can be performed easily without the two portions toeing into each other or hitting each other and thus being damaged.

The invention will now be described with reference to the drawings.

The only FIGURE shows a ventilation nozzle according to the invention which is partially a longitudinal view.

The ventilation nozzle according to the invention comprises a fluid channel 1, which tapers in flow direction 2. An expansion chamber 3 is connected to the fluid channel 1 in flow direction 2. The fluid channel 1 consists of two tube sections, one of the tube sections 4 comprising a frontal flange 5 which is fixed to a flange 7 mounted to the other tube section 6 by fixing screws 8 which are distributed around its circumference. The two tube sections 4, 6 are inserted into each other in telescope fashion. At their overlapping portions the two tube sections 4, 6 limit an annular channel 9. On the inner surface the annular channel is formed by a recess 10 extending on the outer surface of the tube section 6. The outer limitation is partially formed by a recess 11 on the inner surface of tube section 4. A further portion of the outer limitation of the annular channel 9 is formed by the inner diameter of the frontal flange 5. The inner diameter of the flange 5 corresponds to the inner diameter of the recess 11, so that the outer limitation of the annular channel 9 has a constant diameter. A further small portion of the outer limitation of annular channel 9 is formed by the inner diameter of the flange 7, which is formed matching the inner diameter of the flange 5. The flanges 5 and 7 are equal components. The flange 5 is connected to the tube section 4 by welding. The flange 7 is mounted axially to the shell of tube section 6 by welding. The flanges 5, 7 are arranged approximately in the center of the ventilation nozzle.

The frontally arranged flange 5 comprises a circumferential groove 12 having a T-like cross-section on the surface facing the flange 7 into which a sealing ring is inserted. By means of this seal 12 the annular channel 9 is sealed to the exterior.

The tube section 4 comprises a shoulder 13 axially spaced from its frontal end, extending radially inwardly, and limiting the annular channel 9 axially. The frontal end of the other tube section 6 comprises a sealing flange 14 extending radially outwardly into the shoulder 13. The inner diameters of the two tube sections 4, 6 have the same size at this location. An axially open, circumferential groove 15 having a T-like cross-section is formed in the shoulder 13. A seal ring is disposed in the groove 15, said seal ring sealing the annular channel 9 against the fluid channel 1.

A gas supply line 16 is formed in the limitation of the annular channel 9, limited by the tube section 4 comprising the flange 5. Gas passage apertures 17 are formed in the limitation of the annular chamber 9, which is formed by the other tube section 6. The gas is supplied via the gas supply line into the tube section 4, is distributed there and reaches the fluid channel 1 via the gas passage apertures 17.

Now the function of the device according to the invention will be described. For installation, the two tube sections 4, 6 are assembled, with sealing rings being inserted into the grooves 12 and 15 provided in the tube section 4. Then the flanges 5, 7 are fixed to one another by means of fixing screws 8 distributed around their circumference. Then, the ventilation nozzle is installed into the device by means of which the wort or yeast is ventilated and atomized, respectively. The wort is supplied to the fluid channel, so that it flows through the fluid channel 1 in flow direction 2. A gas is guided to the annular channel 9 via the gas supply line 16. The pressure of the gas is selected in a manner that the gas distributes regularly in the annular channel 9 and reaches the fluid channel 1 via the gas passage apertures 17. The fluid is surrounded by the gaseous streams in a web-like manner. The gas/fluid mixture then flows in flow direction 2 further and reaches the tapered end of the fluid channel 1 in which the gas mixes with the fluid. At the end of the tapered fluid channel 1, the gas/fluid mixture reaches the expansion chamber 3 via a pressure drop. Based on this pressure drop the wort/air mixture expands. Thus, a regular formation of bubbles in the wort is generated. Thereby, the flotation is influenced in a way that a very regular foam cover formation is obtained. Upon termination of this mixing process, the ventilation nozzle can be disassembled from the wort ventilation device. In case the ventilation nozzle needs to be cleaned, it can be disassembled to this purpose and can be assemled again and then installed into the wort ventilation device after cleaning. In the same way the ventilation nozzle can be disassembled in case one of the tube sections is damaged or suffers from wear, or one of the tube sections can be replaced and the ventilation nozzle can be assembled again. After the ventilation nozzle is again installed in the wort ventilation device, the ventilation process can start again.

We claim:

1. A ventilation nozzle for fluid, especially for ventilating and atomizing wort and yeast, having a fluid channel, which is tapered in flow direction, and comprising a gas supply line for adding a gas into the fluid channel and an expansion chamber which is connected to the taper in flow direction, characterized in that the fluid channel (1) is formed of two tube sections (4,6) which engage each other in such a telescopic manner that the overlapping portions of the tube sections (4,6) limit an annular chamber (9) formed by circumferential recesses provided on the inner surface of one of the tube sections (4) and on the outer surface of the other tube section (6), and which is sealed with respect to the fluid channel on (1) one hand by means of seals (12, 15) at the frontal ends of the tube sections (4,6) facing each other and with respect to the environment on the other hand, that the portion of the tube section (6) separating the annular channel (9) from the fluid channel (1) is provided with gas passage apertures (17) with the gas supply line (16) opening into the annual channel (9); and that the two tube sections (4,6) are connected to each other by radially outwardly protruding flanges (5,7) and by fixing screws (8) distributed over their circumference, with the flange (5) of the tube section (4) sealing the annular channel (9) to the outside mounted at its frontal end.

2. A ventilation nozzle according to claim 1, characterized in that the frontally arranged flange (5) comprises a circumferential groove (12) at its surface facing the other flange (7), into which one of the seals for the annular channel (9) is inserted.

3. A ventilation nozzle according to claim 2, characterized in that the tube section (4) comprising the frontal flange (5), also comprises the other seal sealing the annular channel (9) which is inserted in a circumferential groove (15), provided in a shoulder (13) axially spaced from the frontal end of the tube section (4) and extending radially inwardly and axially limiting the annular channel (9).

4. A ventilation nozzle according to claim 3, characterized in that the circumferential groove (12,15) has a T-like cross section.

5. A ventilation nozzle according to claim 3, characterized in that the frontal end of the other tube section (6) comprises a radially outwardly protruding sealing flange (14) extending in the shoulder (13) and cooperating with the seal, with the inner diameter of the two tube sections (4,6) having the same size at this location.

6. A ventilation nozzle according to claim 2, characterized in that the circumferential groove (12,15) has a T-like cross section.

7. A ventilation nozzle according to claim 6, characterized in that the frontal end of the other tube section (6) comprises a radially outwardly protruding sealing flange (14) extending in the shoulder (13) and cooperating with the seal, with the inner diameter of the two tube sections (4,6) having the same size at this location.

8. A ventilation nozzle according to claim 1, characterized in that the tube section (4) comprising the frontal flange (5), also comprises the other seal sealing the annular channel (9) which is inserted in a circumferential groove (15), provided in a shoulder (13) axially spaced from the frontal end of the tube section (4) and extending radially inwardly and axially limiting the annular channel (9).

9. A ventilation nozzle according to claim 8, characterized in that the circumferential groove (12,15) has a T-like cross section.

10. A ventilation nozzle according to claim 9, characterized in that the frontal end of the other tube section (6) comprises a radially outwardly protruding sealing flange (14) extending in the shoulder (13) and cooperating with the seal, with the inner diameter of the two tube sections (4,6) having the same size at this location.

11. A ventilation nozzle according to claim 8, characterized in that the frontal end of the other tube section (6) comprises a radially outwardly protruding sealing flange (14) extending in the shoulder (13) and cooperating with the seal, with the inner diameter of the two tube sections (4,6) having the same size at this location.

12. A ventilation nozzle according to any one of claims 1-11 characterized in that the gas supply line (16) is connected to the tube section (4) comprising the frontal flange (5) and opening into the annular channel.

13. A ventilation nozzle according to any one of claims 1-11 characterized in that the frontal flange (5) is manufactured as a separate component and is axially mounted to the tube section (4) and forms a portion of the radial outer limitation of the annular channel (9).

14. A ventilation nozzle according to claim 13, characterized in that the inner diameter of the frontal flange (5) corresponds to the inner diameter of the recess surrounding the inner surface of the tube section (4).

15. A ventilation nozzle according to any one of claims 1-11 characterized in that the flange (7) of the other tube section (6) is manufactured as a separate component and is radially slid on the tube section (6) and fixed there.

16. A ventilation nozzle according to anyone of claims 1-11 characterized in that the flange (7) of the other tube section (6) protrudes axially over a wall (18) axially limiting the annular channel (9) and also forms a portion of the radial outer limitation of the annular channel (9).

17. A ventilation nozzle according to any one of claims 1-11 characterized in that the two flanges (4,6) are equal.

18. A ventilation nozzle according to any one of claims 1-11 characterized in that the flanges (5,7) are arranged approximately in the center of the ventilation nozzle (1).

19. A ventilation nozzle according to any one of claims 1-11 characterized in that the flanges (5,7) are arranged approximately in the center of the ventilation nozzle (1).

* * * * *

UNITED STATES PATENT AND TRADEMARK OFFICE

CERTIFICATE OF CORRECTION

PATENT NO. : 5,240,650

DATED : August 31, 1993

INVENTOR(S) : Johannes Wiederhold and Simon Redl

It is certified that error appears in the above-identified patent and that said Letters Patent is hereby corrected as shown below:

In column 4, claim 1, line 61, please delete "fluid" and substitute therefor --fluids--.

Signed and Sealed this

Nineteenth Day of July, 1994

Bruce Lehman

*Attest:*

BRUCE LEHMAN

*Attesting Officer*

*Commissioner of Patents and Trademarks*